US005659286A

United States Patent [19]

Lin

[11] Patent Number: 5,659,286

[45] Date of Patent: Aug. 19, 1997

[54] DOORBELL BASE

[76] Inventor: Sheng-Hsiung Lin, 306, Wu Fu Road, Wu Feng Hsiang, Taichung, Taiwan

[21] Appl. No.: 639,329

[22] Filed: Apr. 25, 1996

[51] Int. Cl.[6] ..... G08B 3/00

[52] U.S. Cl. ..... 340/328; 340/384.73; 340/392.1; 340/392.2; 340/392.4; 340/401.1; 116/155; 116/169

[58] Field of Search ..... 340/392.2, 392.4, 340/392.5, 396.1, 393.3, 397.1, 388.1, 326, 328, 329, 330, 392.1, 384.73, 401.1; 115/155, 164, 167, 169

[56] References Cited

U.S. PATENT DOCUMENTS

| | | | |
|---|---|---|---|
| 2,820,913 | 1/1958 | Christy | 340/392.5 |
| 3,246,321 | 4/1966 | Doggart | 340/396.1 |
| 3,284,797 | 11/1966 | Roswell | 340/392.5 |
| 5,508,680 | 4/1996 | Larsen et al. | 340/396.1 |

*Primary Examiner*—Jeffery Hofsass
*Assistant Examiner*—Timothy Edwards, Jr.
*Attorney, Agent, or Firm*—Charles E. Baxley, Esq.

[57] ABSTRACT

A doorbell base is made integrally and is provided with two resonators and a hollow housing located between said two resonators. Each of two resonators is provided respectively at two opposite side walls thereof with a locating projection for locating a soft plug of the chime bars. The housing is provided respectively at two opposite sides thereof with a frame hole having at a bottom end thereof an indentation formed integrally with the base. The housing is provided therein with a rectangular hole having two locating clamp bodies with a hooked portion for locating the diminishing neck of a striker. The striker is provided with a coil assembly which is fastened with a fastening piece of power source wires for generating a magnetic repulsion capable of actuating the striker rod of the striker to strike the chime bars to bring about a musical tone.

1 Claim, 4 Drawing Sheets

DOORBELL BASE

FIELD OF THE INVENTION

The present invention relates generally to a doorbell, and more particularly to an improved base of the doorbell.

BACKGROUND OF THE INVENTION

As shown in FIG. 1, a doorbell of the prior art is generally composed of a cover, a chime bar, a base, a striker, and a resonator cover.

The prior art doorbell is not cost-effective in view of the fact that it is rather complicated in construction. For example, the base is made integrally and is provided with two hollow resonators which are provided respectively in a front wall there of and a rear wall thereof with a locating projection. The locating projection is provided at the top thereof with a diminishing neck portion, which is attached securely to the bottom of the hollow resonators located at both sides of the base. Located between the two resonators are two locating slots. The base is provided by punching with a through hole located between the two locating slots.

The structural complexity of the prior art doorbell is further evident by the fact that the striker of the prior art doorbell is rather complicated in construction. For example, the striker comprises a hollow member fitted in to a coil. The hollow member is provided respectively at the front end thereof and the rear end thereof with a short tube edge, which is retained in a locating through hole of a U-shaped body. A striking bar is first fitted into a spring before it is disposed in the hollow interior of the striker. The U-shaped body is provided respectively by punching at the bottoms of the front and the rear sides thereof with a protruded portion engageable with the locating slot. The U-shaped body is further provided at the lower end thereof with two legs, which are located in the through holes located between two frame edges. The U-shaped body is still further provided at the top end thereof with two legs, which are located in the through holes of a flat plate on which a fastening piece of the power source wire is fastened by means of screws. The coil of the striker is connected with the fastening piece of the power source wire.

It must be not here that the rejection rate of the prior art doorbell described above is relatively high, and that the U-shaped body, the striker and the base of the prior art doorbell described above can not be fastened securely.

SUMMARY OF THE INVENTION

It is therefore the primary objective of the present invention to provide an improved doorbell, which can be made economically.

It is another objective of the present invention to provide an improved doorbell, which can be produced at a low rejection rate.

The foregoing objectives of the present invention are attained by a doorbell, which comprises a base provided integrally with a hollow housing located between two resonators. The housing is provided respectively in the front and the rear sides thereof with a frame hole having at the bottom thereof an indentation which is made integrally with the base. The housing is provided at the top thereof with a rectangular hole which is in turn provided at a predetermined position of the midsegment of the hole edge with two locating clamp bodies of a hooked construction. The housing is intended to locate the diminishing neck of the striker such that the coil assembly of the striker is connected with the power source wire fastening piece located at one end of the rectangular hole of the housing.

The forgoing objectives, features and functions of the present invention will be more readily understood upon a thoughtful deliberation of the following detailed description of the present invention in conjunction with the accompanying drawings.

DETAILED DESCRIPTION OF THE INVENTION

Figure 1:
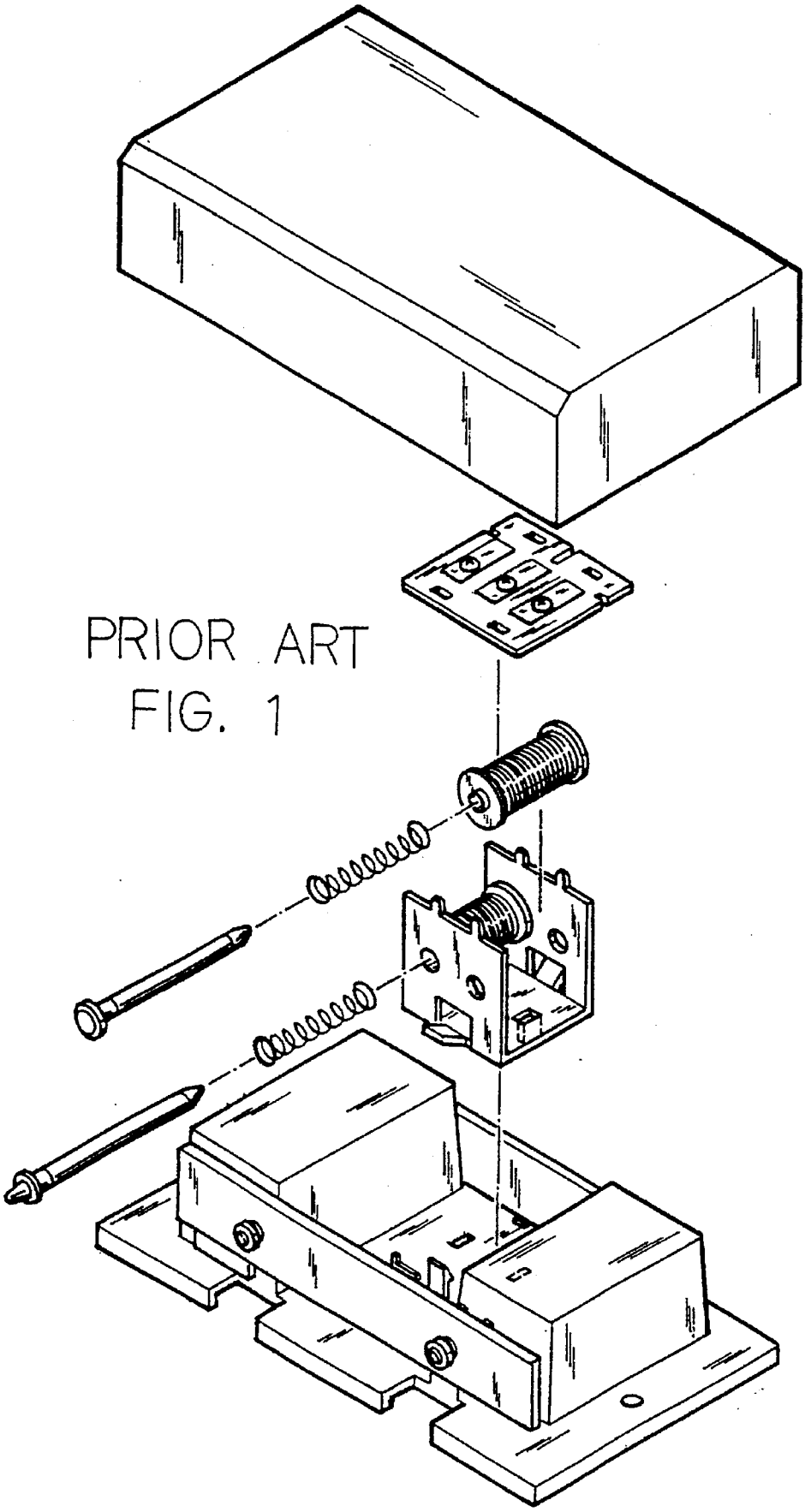
PRIOR ART FIG. 1
FIG. 1 shows an exploded view of a doorbell of the prior art.
Figure 2:
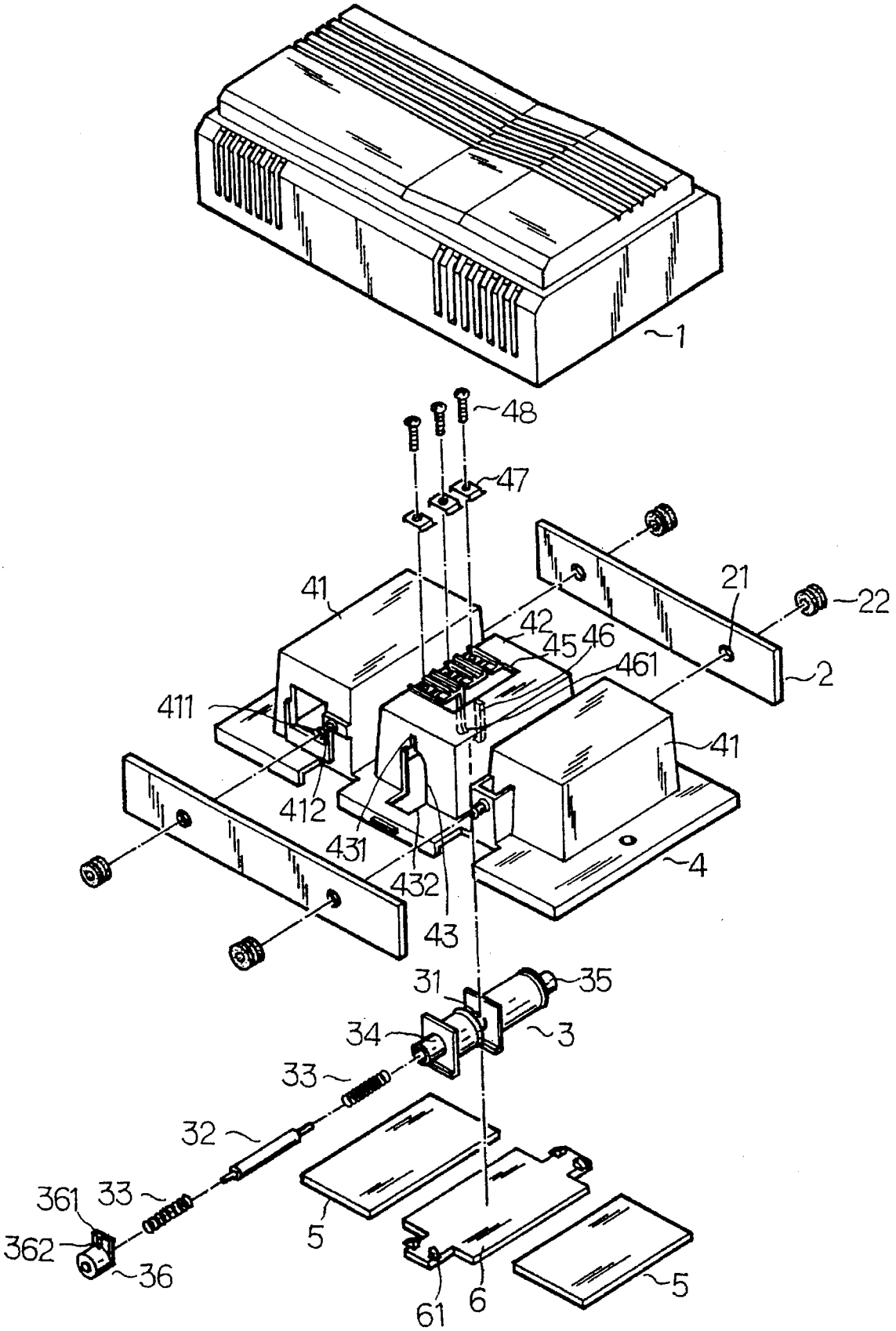
FIG. 2 shows an exploded view of a doorbell of the present invention.
Figure 3:
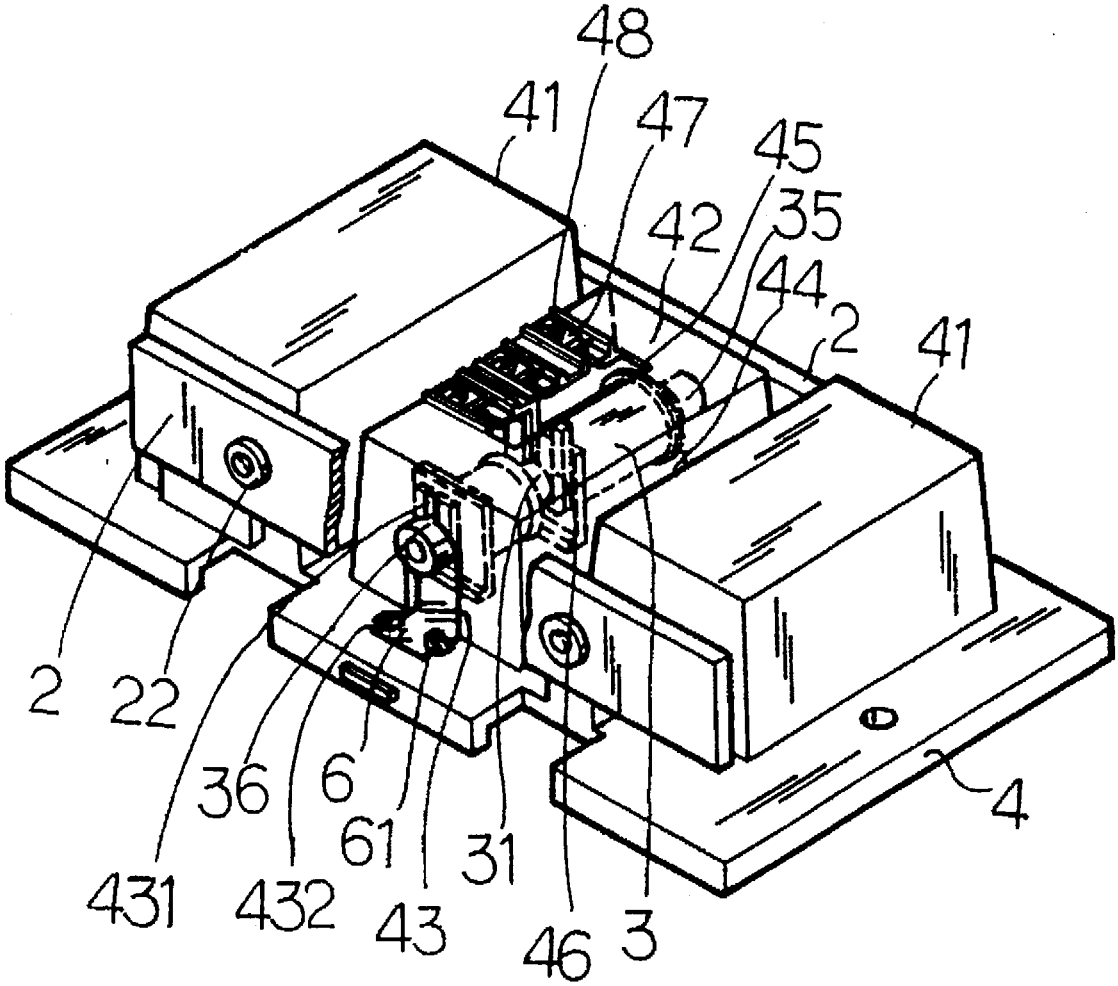
FIG. 3 shows a perspective view of the present invention in combination.
Figure 4:
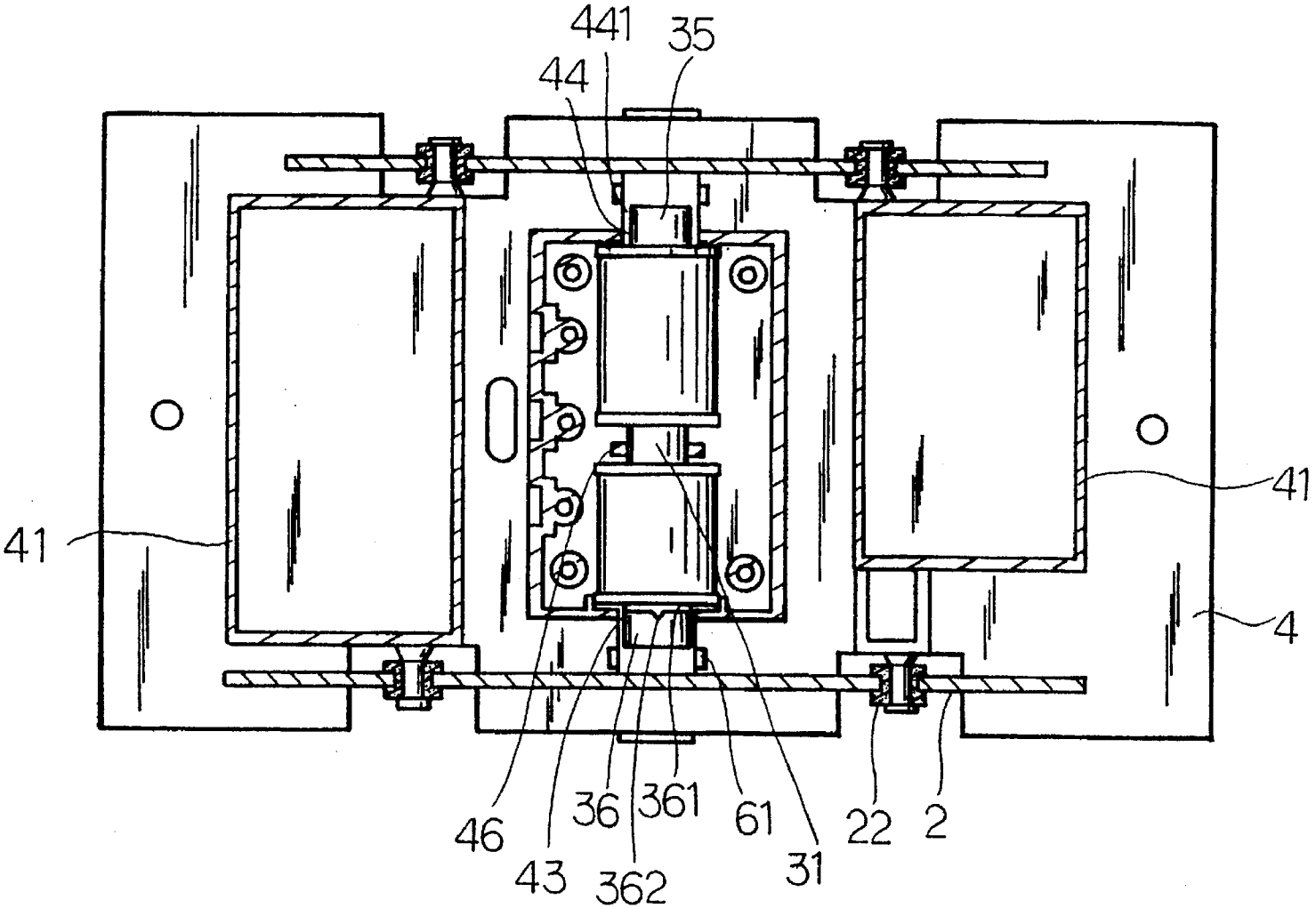
FIG. 4 shows a sectional view of the present invention in combination.

As shown in FIGS. 2, 3 and 4, a doorbell embodied in the present invention comprises a cover 1, two chime bars 2, a striker 3, a base 4, a left resonator cover 5, a right resonator cover 5, and a middle cover 6.

The cover 1 is similar in construction to a housing.

Two chime bars 2 are provided respectively at both ends thereof with two through holes 21 having a soft plug 22 fitted thereinto.

The striker 3 is provided in the midsegment thereof with a diminishing neck 31 for accommodating a coil assembly. The striker 3 is further provided at both ends thereof with tubular portions 34 and 35. The tubular portion 34 has a hollow interior in which a striker rod 32 is disposed.

The striker rod 32 is fired respectively at both ends thereof into a coil spring 33. The tubular portion 34 of the striker 3 is fastened with a stopping body 36 enabling the striker rod 32 of the striker 3 to extend out of the stopping body 36 without being disengaged from the striker 3. The stopping body 36 is provided at one end thereof with a wing 361 having a longitudinally-oriented stopping edge 362.

The base 4 is made integrally and is provided with two hollow resonators 41 opposite in location to each other. Each of two resonators 41 is provided respectively in a front side wall thereof and a rear side wall thereof with a locating projection 411 having at the top thereof a diminishing neck 412 for locating the plug 22 of the chime bars 2. The base 4 is further provided integrally with a hollow housing 42 which is located between two resonators 41 and is provided in the front and the rear sides thereof with frame holes 43 and 44. The frame hole 43 is provided at the upper end thereof with a retaining hole 431. The frame holes 43 and 44 are further provided respectively at the bottoms thereof with indentations 432 and 441, which are made integrally with the base 4. The housing 42 is provided at the top thereof with a rectangular hole 45 having two locating clamp bodies 46 extending from a predetermined position of the hole edge thereof and having a hooked end 461 for retaining the diminishing neck 31 of the striker 3 such that the top edge of the front frame hole 43 of the housing 42 is urged by the top end of the stopping body 36, and that the wing 361 is intimately attached to the inner edge of the front side of the housing 42, and further that the stopping edge 362 of the stopping body 36 is engaged with the retaining hole 431 of the front frame hole 43 of the housing 42. In the meantime, the rear end of the striker 3 is attached to the inner edge of the rear side of the housing 42 while the time hole 44 of the housing 42 is urged by the top end of the tubular portion 35 of the striker 3. In other words, the striker 3 is held securely in place. The coil assembly mounted on the striker 3 is connected by means of screws 48 with three fastening pieces 47 of the power source wire.

The left resonator cover 5 and the right resonator cover 5 are attached respectively to the bottoms of the resonators 41. The middle cover 6 is provided at both ends of the longitudinal axis thereof with two retaining bodies 61 engageable securely with the indentations 432 and 441 of the frame holes 43 and 44.

The coil assembly of the striker 3 is triggered by the electric current to generate a magnetic repulsion which actuates the striker rod 32 of the striker 3 to strike the chime bars 2 and to bring about a musical tone.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

What is claimed is:

1. A doorbell comprising:

a cover having a receiving space;

two chime bars each including two through holes and each including two soft plugs fitted in said through holes respectively;

a striker including two ends and including a midsegment having a diminishing neck for fitting with a coil assembly, said diminishing neck including an interior, said striker including two stopping bodies secured to said ends of said striker;

two springs engaged in said interior of said diminishing neck;

a striking rod received in said interior of said diminishing neck and including two ends engaged in said springs;

a base including an integral configuration having two resonators, said resonators each including a hollow construction and each including two opposite side walls, said side walls each including a locating projection having a diminishing neck for engaging with said soft plug of said chime bar, said resonators each including a bottom portion, said base including a housing formed integral with said base and located between said resonators and having a hollow construction, said housing including a longitudinal axis having two ends each including a frame hole and a retaining hole and an indentation, said frame holes each being defined by a top edge and being provided for engaging with said ends of said striker for allowing said striker to be quickly assembled in place, said housing including an upper portion having a rectangular hole formed therein, two locating clamp bodies extended downward and inward of said housing from said upper portion of said housing, said locating clamp bodies each including a hooked portion for engaging with and for retaining said diminishing neck of said striker;

two resonator covers secured to said bottom portions of said resonators respectively; and a middle cover including a longitudinal axis having two ends each including a retaining hook engaged through said identations of said and engaged with said base for allowing said middle cover to be quickly secured to said base and for allowing said middle cover to retain said striker within said housing;

said stopping bodies of said striker being engaged in said frame holes, a first of said stopping bodies being engaged with said top edge for defining said frame hole, and a second of said stopping bodies including a wing for engaging with said base and including a stopping edge for engaging with said retaining hole and for preventing said striker rod from being disengaged from said striker.

* * * * *